US007012570B2

(12) United States Patent
Chen et al.

(10) Patent No.: US 7,012,570 B2
(45) Date of Patent: Mar. 14, 2006

(54) ANTENNA WITH PRINTED COMPENSATING CAPACITOR

(75) Inventors: Kai-Te Chen, Hsinchu (TW); Jan-Kwo Leeng, Hsinchu (TW); Tsung-Liang Lin, Hsinchu (TW)

(73) Assignee: Mediatek Incorporation, Hsinchu (TW)

( * ) Notice: Subject to any disclaimer, the term of this patent is extended or adjusted under 35 U.S.C. 154(b) by 38 days.

(21) Appl. No.: 10/658,173

(22) Filed: Sep. 8, 2003

(65) Prior Publication Data

US 2004/0227672 A1 Nov. 18, 2004

Related U.S. Application Data

(60) Provisional application No. 60/470,906, filed on May 15, 2003.

(51) Int. Cl.
*H01Q 1/38* (2006.01)
*H01Q 1/24* (2006.01)

(52) U.S. Cl. ..... 343/700 MS; 343/702; 343/815

(58) Field of Classification Search ..... 343/700 MS, 343/702, 745, 815–818, 845
See application file for complete search history.

(56) References Cited

U.S. PATENT DOCUMENTS

| | | | | |
|---|---|---|---|---|
| 6,133,879 | A * | 10/2000 | Grangeat et al. | 343/700 MS |
| 6,343,208 | B1 * | 1/2002 | Ying | 455/575.7 |
| 6,408,190 | B1 * | 6/2002 | Ying | 455/553.1 |
| 6,606,062 | B1 * | 8/2003 | Coupez et al. | 343/700 MS |
| 6,693,593 | B1 * | 2/2004 | Burgess | 343/700 MS |
| 6,707,431 | B1 * | 3/2004 | Byun et al. | 343/702 |
| 6,720,924 | B1 * | 4/2004 | Tomomatsu et al. | 343/700 MS |
| 6,738,023 | B1 * | 5/2004 | Scott et al. | 343/700 MS |
| 6,747,600 | B1 * | 6/2004 | Wong et al. | 343/700 MS |
| 2003/0117325 | A1 * | 6/2003 | Jo et al. | 343/702 |

* cited by examiner

*Primary Examiner*—Thuy V. Tran
*Assistant Examiner*—Hung Tran Vy
(74) *Attorney, Agent, or Firm*—J.C. Patents

(57) ABSTRACT

An antenna on a printed circuit board (PCB) with a compensating capacitor. The antenna has a radiator disposed over a first surface of the PCB. Wherein the radiator includes a signal feeding section and a tuning section coupled together at a joint. The tuning section includes a bending portion. Also and, a ground layer with or without a protuding portion is disposed on a second surface of the PCB, wherein the bending portion of the tuning section is overlapping with the ground layer to form the compensating capacitor. In addition, the radiator can also have a short circuit stub section, electrically coupled to the ground layer.

16 Claims, 5 Drawing Sheets

ANTENNA WITH PRINTED COMPENSATING CAPACITOR

CROSS-REFERENCE TO RELATED APPLICATION

This application claims the priority benefits of U.S. provisional application titled "MINIATURING PRINTED ANTENNA WITH LOAD PRINTED CAPACITOR" filed on May 15, 2003, Ser. No. 60/470,906. All disclosure of this application is incorporated herein by reference.

BACKGROUND OF THE INVENTION

1. Field of Invention

The present invention relates to a communication antenna. More particularly, the present invention relates to an antenna with an additional capacitor, so as to reduce the dimension of the antenna and maintain the required LC coupling strength.

2. Description of Related Art

The wireless communication system always needs an antenna to transmit and receive RF signals. In recent years, the wireless communication technology has been well developed. For example, the cellular phone is one of the impressing apparatus in wireless communication. The dimension of the cellular phone require an antenna. In order to implement the antenna in compact space, a planar, a line inverted-F, or L-type antennas have been proposed. However, these conventional antennas are not implemented on the plane of a printed circuit board (PCB). Also the antenna has to match to a certain ratio of the wavelength, such as 1/4 λ, with respect to the transmission frequency of, i.e. about 2.4 GHz.

FIG. 1 shows a transmission line of characteristic impedance $Z_0$, propagation constant β, and length L, loaded with an impedance $Z_L$. By the transmission line theory, the input impedance $Z_{in}$ and the corresponding input admittance $Y_{in}$ can be expressed as follows:

$$Z_{in} = Z_o \frac{Z_L + jZ_o \tan\beta L}{Z_o + jZ_L \tan\beta L}, \quad (1)$$

and (2)

$$Y_{in} = Y_o \frac{Y_L + jY_o \tan\beta L}{Y_o + jY_L \tan\beta L},$$

where, $Y_{in} = \frac{1}{Z_{in}}$, $Y_o = \frac{1}{Z_o}$, and $Y_L = \frac{1}{Z_L}$.

If $Z_L$ is zero (short-circuited), the input impedance $Z_{in}$, denoted by $Z_{ins}$, is $$Z_{ins} = jZ_o \tan \beta L$$

or $$Y_{ins} = -jY_o \cot \beta L.$$

If $Z_L$ is infinite (open-circuited), the input impedance $Z_{in}$, denoted by $Z_{ino}$, is, $$Z_{ino} = -jZ_o \cot \beta L$$

or $$Y_{ino} = jY_o \tan \beta L.$$

Based on the antenna theory, FIG. 2 shows an in conventional design of L-type compact antenna. In FIG. 2, the L-type antenna 102 includes a tuning section 102*a* and a signal feeding section 102*b* connected at one end by a right angle, wherein a signal feeding line 103, which is the portion over the ground layer 100, is coupled to the signal feeding section 102*b*. A ground layer 100 is implemented under a signal feeding line 103 without direct connection. The tuning section 102*a* itself provides the LC coupling with the ground layer. An insulating layer (not shown) may exist between the ground layer 100 and the signal feeding line 103. The insulation layer in the specification is omitted but can be understood by the skilled artisans.

FIG. 3 shows the antenna mechanism to the L-type antenna in FIG. 2. In conventional design, the L type antenna is based on concept of monopole antenna. The length of tuning section 102*a* in monopole approximates quarter wavelength in resonant frequency. The tuning section 102*a* and the nearby ground plane 100 form an open-ended transmission line. The input impedance of this open line is $Z_{in} = -jZ_o \cot \beta L'$, which corresponds to an equivalent capacitance $C_M$ of $$C_M = \frac{\tan\beta L'}{\omega \cdot Z_0}.$$

The equivalent capacitance would resonate at the angular frequency ω with the small inductance provided by the signal feeding section 102*b* of the L-type antenna.

Another type of conventional antenna is an inverted F antenna as shown in FIG. 4. The antenna 200 includes the short circuit stub section 200*a*, a signal feeding section 200*c*, and a tuning section 200*b*, which elements couple together at a joint. The inverted F antenna is similar to the L-type antenna but additionally includes the short circuit stub section 200*a*, which is directly coupled to the ground layer 100. FIG. 5 shows the antenna mechanism with respect to the inverted F antenna shown in FIG. 4.

In the foregoing conventional antennas, the tuning section 200*b* is a straight line and has a required length to satisfy the receiving/transmission operation with respect to the working frequency. Usually, the length L is 1/4 λ to have sufficient LC coupling effect. This causes the dimension to be large.

Moreover, the conventional antenna is implemented, extending outward on the house of the communication apparatus. This is not a compact design, and needs additional fabrication process.

SUMMARY OF THE INVENTION

The invention provides an antenna with a printed compensating capacitor. As a result, the length of tuning section of the antenna can be reduced but keeping the required LC coupling effect.

The invention provides an antenna with a printed compensating capacitor. The antenna can be formed on a PCB, and a portion of the tuning section of the antenna is overlapped with the ground layer, so as to produce a compensating capacitor, which compensates the required capacitance even though the length of the tuning section is reduced.

The invention provides an printed antenna, in which the antenna is formed on the PCB. The fabrication process of the antenna is compatible for the processes to form the electronic elements on the PCB. The mechanical strength of the antenna is improved. The antenna is directly formed on the PCB, so as to have the better compact assembly.

As embodied and broadly described herein, the invention provides an antenna with a compensating capacitor. The antenna includes a radiator disposed over a first surface of the PCB. Wherein, the radiator includes a signal feeding section and a tuning section coupled together at a joint. The tuning section includes a bending portion. Also and, a ground layer is disposed on a second surface of the PCB, wherein the bending portion of the tuning section is overlapping with the ground layer to form the compensating capacitor. In addition, the radiator can also have a short circuit stub section, electrically coupled between the joint and the ground layer.

In the foregoing antenna, the ground layer includes a protruding portion from an edge, wherein the protruding portion is at least overlapping with the bending portion of the tuning section to form the compensating capacitor.

In the foregoing antenna, the bending portion of the tuning section extends into the ground layer, crossing over the protruding portion.

In the foregoing antenna, the bending portion of the tuning section extends crossing over an edge of the ground layer.

The invention also provides a method for forming an antenna on a PCB, including forming a radiator on the PCB at one side. Wherein, the radiator disposed on a first surface of the PCB, and the radiator at least includes a signal feeding section and a tuning section join at a joint, wherein the tuning section includes a bending portion. A ground layer is formed on the PCB, wherein the bending portion of the tuning section is arranged to have overlapping with a portion of the ground layer to form a compensating capacitor.

In the foregoing method, the step of forming the ground layer includes forming a protruding portion from an edge, wherein the protruding portion is at least overlapping with the bending portion of the tuning section to form the compensating capacitor.

In the foregoing method, the step of forming the ground layer includes forming the bending portion of the tuning section to extend crossing over an edge of the ground layer.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 5:
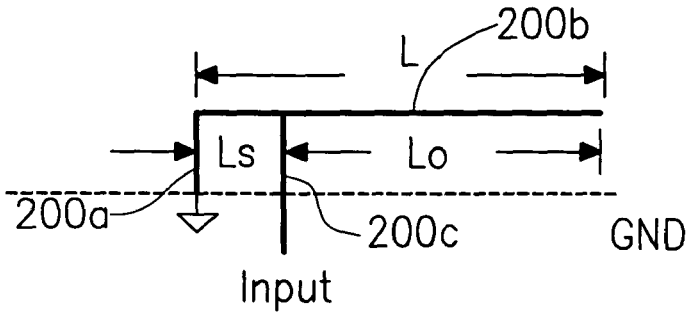
FIG. 5 (PRIOR ART)

According to the microstrip line theory, the tuning section and the short circuit stub section have different characteristics by their respective length $L_o$ and $L_s$, as shown in FIG. 5. Referring back to FIG. 5, the short circuit stub section 200*a* provides the inductive effect and the tuning section 200*b* is a capacitive element when their length $L_o$ and $L_s$ are respectively smaller than quarter wavelength. Actually, the radiator, such as an inverted F antenna, includes a short circuit stub section and a tuning section.

Since the tuning section 200*b* needs the length near 1/4 wavelength, the radiator of the inverted F antenna spends much space for tracing out. This causes the size of antenna to be large.

Figure 6:
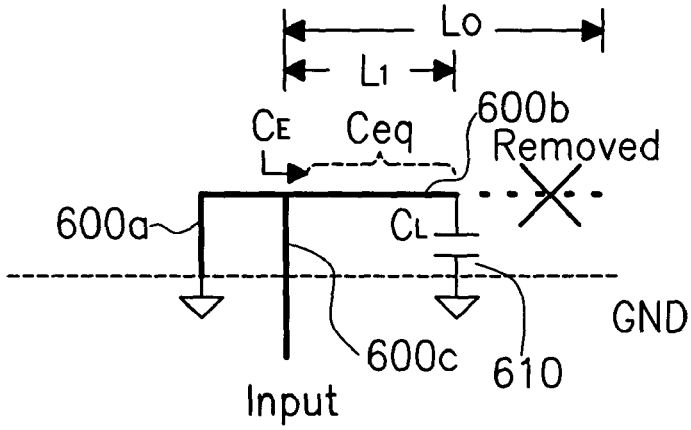
FIGS. 6–7 are drawings, schematically illustrating the equivalent circuit of various antennas, according to the embodiment of present invention.

One issue investigated in the invention is as follows. Given the equivalent capacity from feeding point forward the tuning section as $C_F$ in inverted F antenna, an external or distributed capacitor may be used being electrically coupled between the tuning section and the ground as shown in FIG. 6. In FIG. 6, the novel antenna includes for example, a short circuit stub section 600*a* coupled to the ground, a tuning section 600*b* with a reduced length, a signal feeding section 600*c*, and a compensating capacitor 610 providing a capacitance of $C_L$. In this manner, a portion of the conventional tuning section (200*b*) can be replaced by the tuning section 600*b* in reduced length. The missing capacitance from the tuning section 600*b* is compensated by the compensating capacitor 610. The total equivalent capacitance $C_E$ is preferably to be about equal to the desired capacitance $C_F$ with respect to the antenna in FIG. 5. The theoretic deriving should be understood by the skilled artisans, and is not further described.

Figure 1:
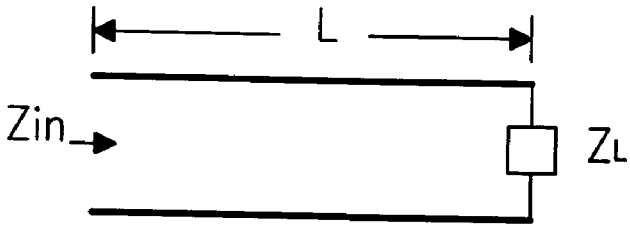
FIG. 1 (PRIOR ART)
FIG. 1 is a drawing, schematically illustrating a loaded transmission line.
Figure 2:
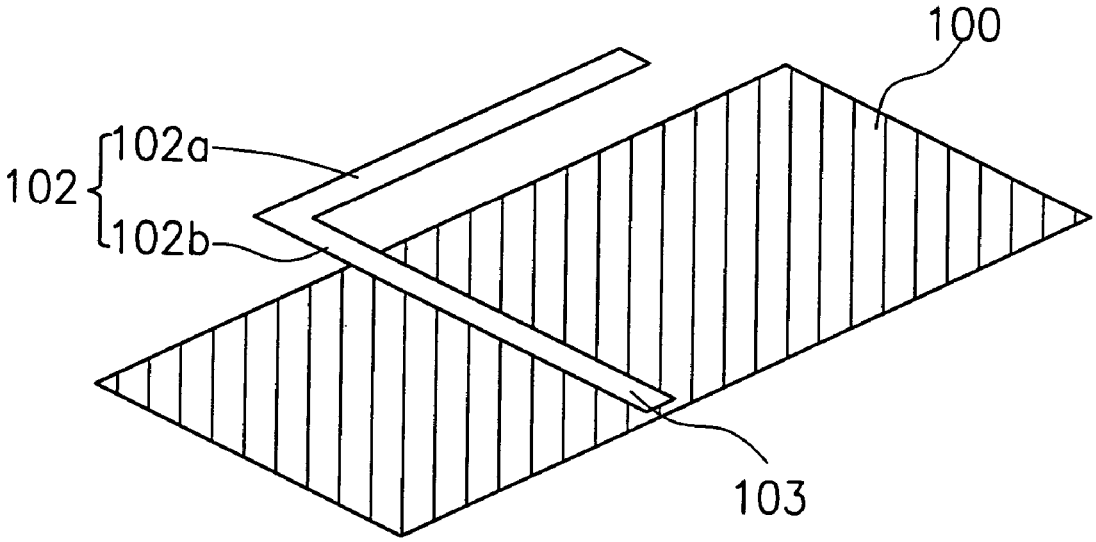
FIG. 2 (PRIOR ART)
FIGS. 2–5 are drawings, schematically illustrating various conventional antennas.
Figure 3:
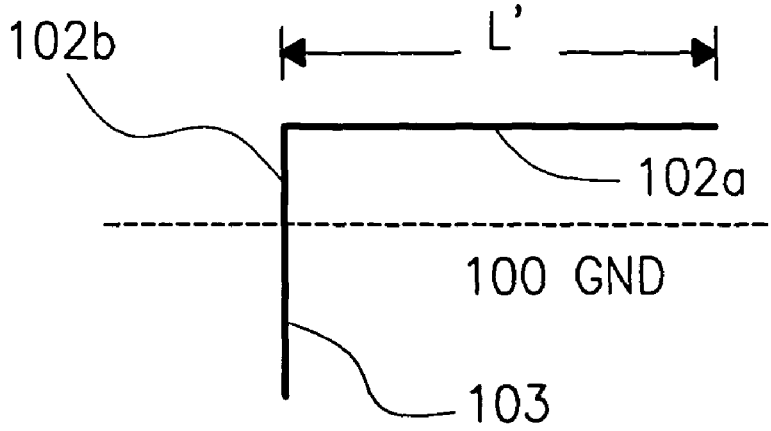
FIG. 3 (PRIOR ART)
Figure 4:
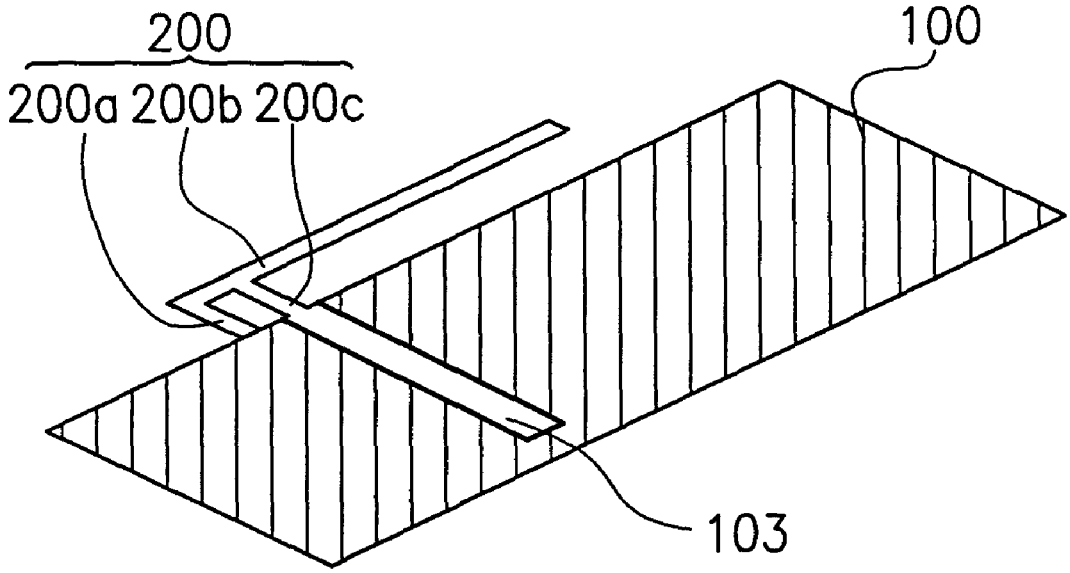
FIG. 4 (PRIOR ART)
Figure 7:
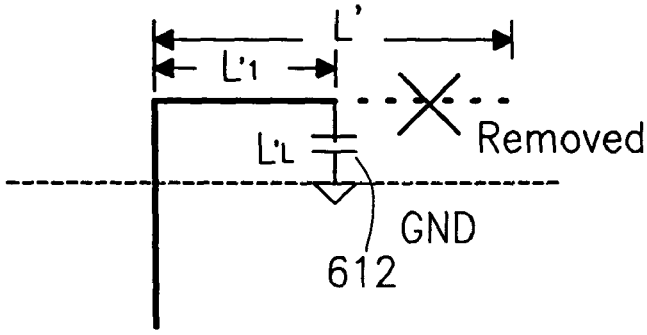

Likewise, the conventional antenna design in FIG. 3 can also be modified into the L-type design in FIG. 7, according to the present invention. In L-type antenna, since the length $L'_l$ of the tuning section of the invention is reduced, the capacitance is accordingly reduced. However, the compensating capacitor 612 provides the missing portion of the capacitance. As a result, the required LC coupling effect for the L-type antenna is achieved.

In order to implement the mechanism of antenna in FIGS. 6–7, several examples are provides for descriptions. The design based on the inverted F antenna is first described. The invention proposed an inverted E antenna, for example, as shown in FIGS. 8–9.

Figure 8:
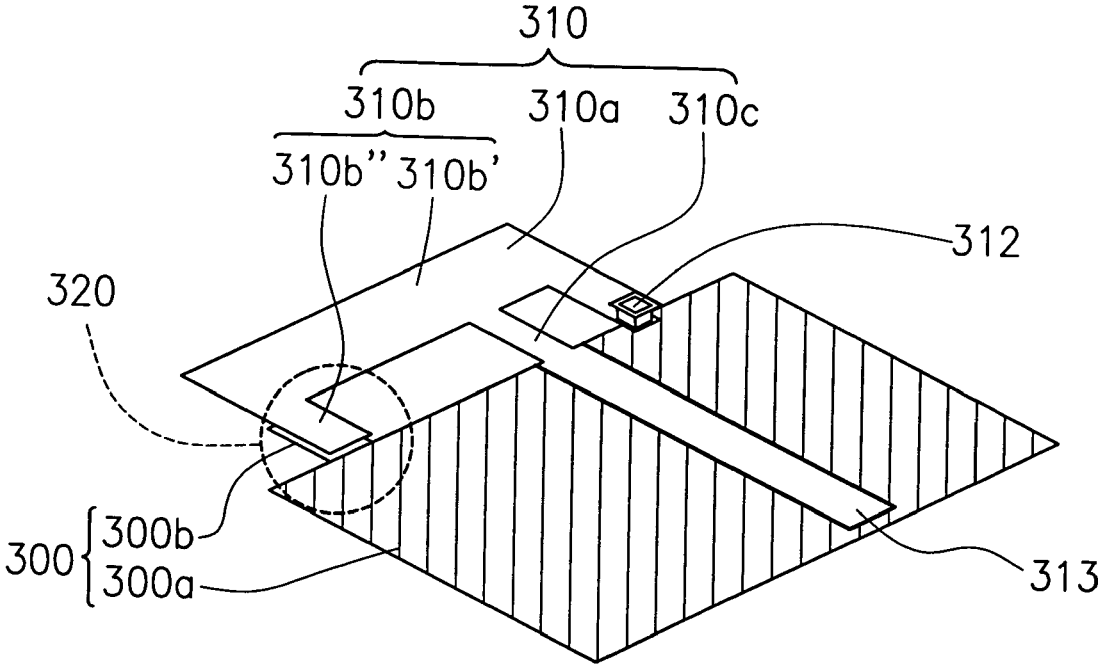
FIGS. 8–9 are drawings, schematically illustrating an antenna structure, according to a first embodiment of present invention.

In FIG. 8, the inverted E antenna 310 of the invention includes, for example, a short circuit stub section 310*a*, a tuning section 310*b* serving like an open stub, and a signal feeding section 310*c*, wherein the signal feeding section 310*c* is coupled to a signal feeding line 313, which is formed over the ground layer 300 at one side of the PCB. In general, the width of the signal feeding section 310*c* can be different from that of the signal feeding line. The three elements 310*a*, 310*b* and 310*c* are coupled together at one joint. As the previous mention, the PCB is omitted in drawing but can be understood by the skill artisans. The PCB, for example, is a double-side PCB. The antenna 310 and the signal feeding line 313 are formed on one side of the PCB. Usually, the other side of the PCB has a ground layer 300. The PCB or an insulating layer isolates the antenna 310 and the signal feeding line 313 from the ground layer 300, and provides a desired separation distance. One end of the short circuit stub section 310*a* is electrically coupled to the ground layer 300 by a through hole structure 312 or the plug structure in the PCB.

The tuning section 310*b* includes a main portion 310*b*' and the bending portion 310*b*". The bending portion 310*b*" is used to produce the compensation capacitor with the ground layer 300. In this example, the ground layer 300 includes, for example, a main portion 300*a* and a protruding portion 300*b*. As a result, the protruding portion 300*b* of the ground layer 300 is coupled with the bending portion 310*b*" to form the compensating capacitor 320.

Figure 9:
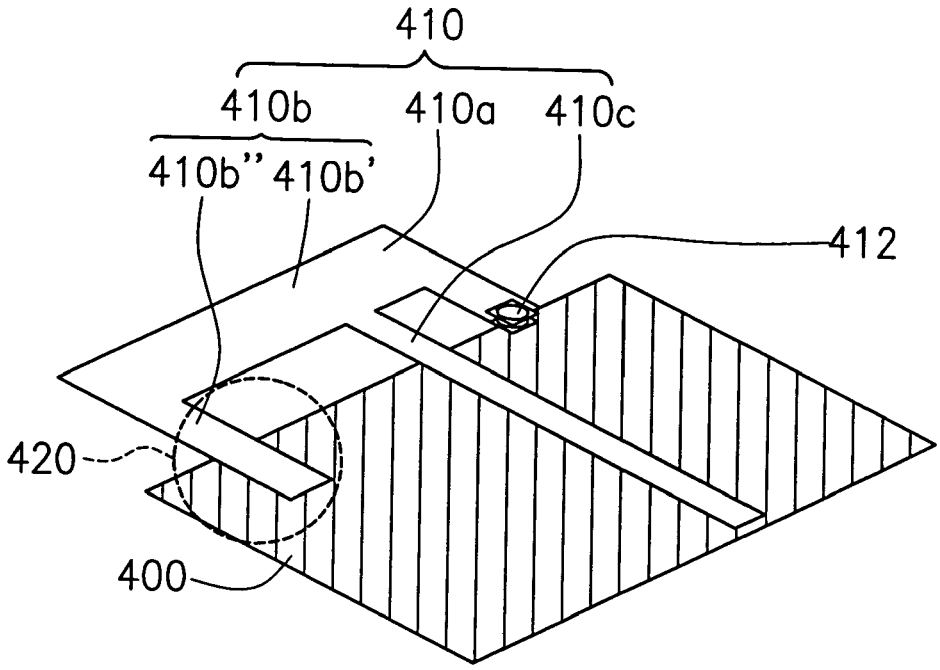

Alternatively, FIG. 9 shows another design option based on FIG. 8. In FIG. 9, the ground layer 400 may need not to have the protruding portion. Instead, the bending portion 410*b*" extends into the ground layer 400 to form the capacitor 420.

In general, it has been sufficient for the tuning section to have a bending portion, which can couple with the ground layer to form the compensating capacitor. The properties in FIGS. 8–9 can also be combined. In other words, the bending portion 310*b*" in FIG. 8 can even extend into the ground layer 300*a*, crossing the edge of the ground layer 300*a*.

Also and, the shape and size of the protruding portion 310*b*", 410*b*" are not limited to the drawings in bar or strip shape. It can be varied into different shape, such as round shape etc. The bending angle is also not necessary to be limited to the right angle. The bending portion can even be a smooth bending.

Figure 10:
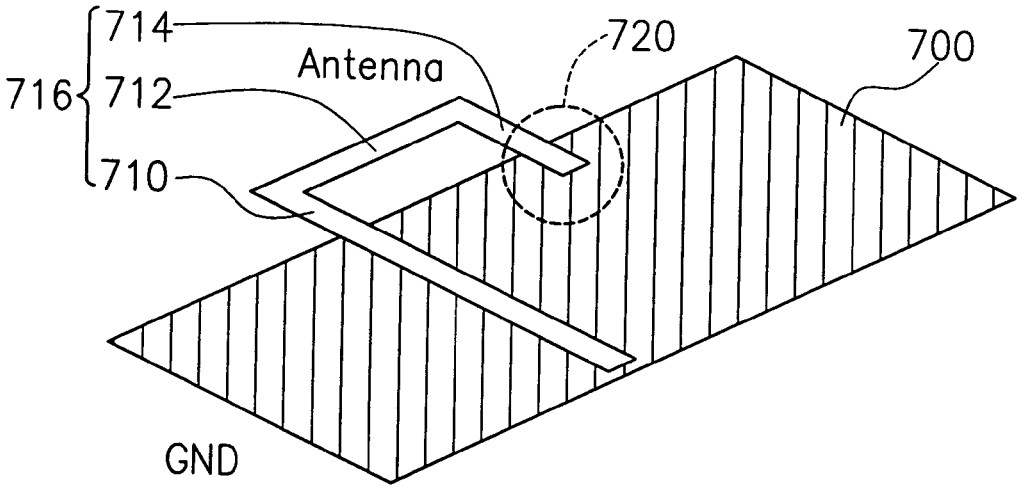
FIGS. 10–11 are drawings, schematically illustrating an antenna structure, according to a second embodiment of present invention.
Figure 11:
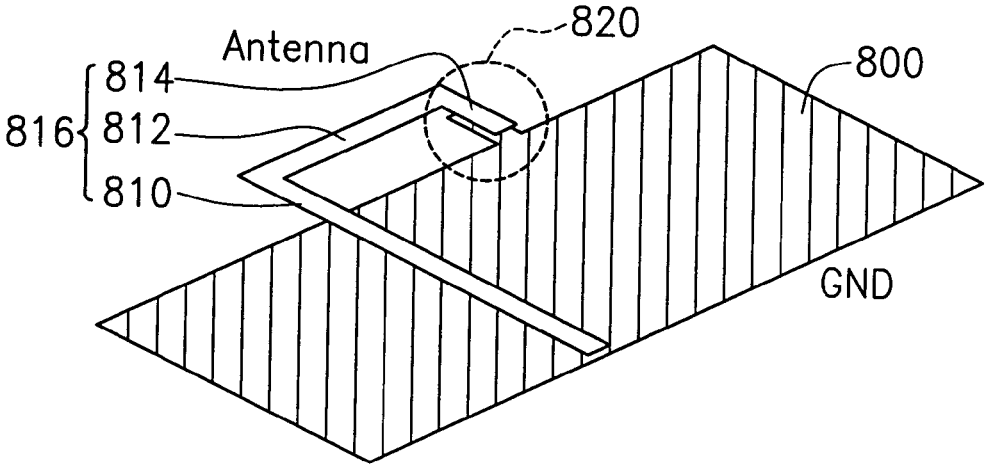

The same design principle of the invention can be applied to the L-type antenna as shown in FIGS. 10–11. The antenna 716, 816 is separated from the ground layer 700, 800 by an insulating layer, such as the PCB (not shown). The compensating capacitors 720 and 820 can be formed by the same foregoing principle in FIGS. 8–9.

The invention can be applied, for example to the wireless communication, the handhold personal communication system, or the compact or small size RF module. Since the length of the tuning section of the antenna in the invention can be effectively reduced, the size of the antenna is accordingly reduced. Since the antenna is directly formed on the PCB, the mechanical strength is improved, and the compactness of elements is also improved.

According to the invention, from the fabrication point of view, the invention also provides a method for forming an antenna on a PCB, including forming a radiator on the PCB at one side. Wherein, the radiator disposed on a first surface of the PCB, and the radiator at least includes a signal feeding section and a tuning section join at a joint, wherein the tuning section includes a bending portion. A ground layer is formed on the PCB at the other side, wherein the bending portion of the tuning section is arranged to have overlapping with a portion of the ground layer to form a compensating capacitor. The radiator can further include a short circuit stub section to have the inverted E antenna.

In the foregoing method, the step of forming the ground layer includes forming a protruding portion from an edge, wherein the protruding portion is at least overlapping with the bending portion of the tuning section to form the compensating capacitor.

In the foregoing method, the step of forming the ground layer includes forming the bending portion of the tuning section to extend crossing over an edge of the ground layer.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. An antenna on a printed circuit board (PCB) with a compensating capacitor, the antenna comprising:

a radiator disposed over a first surface of the PCB, wherein the radiator includes a short circuit stub section, a signal feeding section, and a tuning section coupled together at a joint, wherein the tuning section includes a bending portion;

a signal feeding line, disposed on the first surface of the PCB and electrically coupled to the radiator at the signal feeding section of the radiator; and a ground layer, disposed on a second surface of the PCB, a projection of the radiator is out side of the ground layer with one terminal of the short circuit stub section being electrically coupled to the ground layer and the bending portion of the tuning section being overlapping with the ground layer to form the compensating capacitor.

2. The antenna of claim 1, wherein the ground layer includes a protruding portion from an edge, wherein the protruding portion is at least overlapping with the bending portion of the tuning section to form the compensating capacitor.

3. The antenna of claim 2, wherein the bending portion of the tuning section extends into the ground layer, crossing over the protruding portion.

4. The antenna of claim 1, wherein the bending portion of the tuning section extends crossing over an edge of the ground layer.

5. An antenna on a printed circuit board (PCB) with a compensating capacitor, the antenna comprising:

a radiator disposed over a first surface of the PCB, wherein the radiator includes a signal feeding section and a tuning section coupled together at a joint, wherein the tuning section includes a bending portion;

a signal feeding line on the first surface of the PCB, electrically coupled to the radiator at the signal feeding section of the radiator; and a ground layer, disposed on a second surface of the PCB, a projection of the radiator is out side of the ground layer with the bending portion of the tuning section being overlapping with the ground layer to form the compensating capacitor.

6. The antenna of claim 5, wherein the ground layer includes a protruding portion from an edge, wherein the protruding portion is at least overlapping with the bending portion of the tuning section to form the compensating capacitor.

7. The antenna of claim 6, wherein the bending portion of the tuning section extends into the ground layer, crossing over the protruding portion.

8. The antenna of claim 5, wherein the bending portion of the tuning section extends crossing over an edge of the ground layer.

9. A method for forming an antenna on a printed circuit board (PCB), the method comprising:

forming a radiator over a first surface of the PCB, wherein the radiator at least includes a signal feeding section and a tuning section coupled at a joint;

forming a signal feeding line on the PCB, wherein the signal feeding line is electrically coupled to the radiator at the signal feeding section; and forming a ground layer over a second surface of the PCB, a projection of the radiator is out side of the ground layer with a portion of the tuning section is arranged to have overlapping with a portion of the ground layer to form a compensating capacitor.

10. The method of claim 9, wherein the radiator is further formed with a short circuit stub section, wherein one terminal of the short circuit stub section is electrically coupled to the ground layer short circuit stub section.

11. The method of claim 10, wherein in the step of forming the ground layer, the ground layer is formed to include a protruding portion from an edge, wherein the protruding portion is at least overlapping with the portion of the tuning section to form the compensating capacitor.

12. The method of claim 11, wherein the portion of the tuning section is formed to extend into the ground layer, crossing over the protruding portion.

13. The method of claim 10, wherein the portion of the tuning section has a bending portion which extends crossing over an edge of the ground layer.

14. The method of claim 9, wherein in the step of forming the ground layer, the ground layer is formed to include a protruding portion from an edge, wherein the protruding portion is at least overlapping with the portion of the tuning section to form the compensating capacitor.

15. The method of claim 14, wherein the portion of the tuning section is formed to extend into the ground layer, crossing over the protruding portion.

16. The method of claim 9, wherein the portion of the tuning section has a bending portion which extends crossing over an edge of the ground layer.

* * * * *